US006361302B1

(12) United States Patent
Hinzpeter et al.

(10) Patent No.: US 6,361,302 B1
(45) Date of Patent: Mar. 26, 2002

(54) ROTARY TABLETTING MACHINE

(75) Inventors: Jürgen Hinzpeter; Ulrich Zeuschner, both of Schwarzenbek; Hans-Joachim Pierags, Reinsbek; Nils Petersen, Hohnstorf; Peter Lüneburg, Berkenthin; Elke Wittenberg, Gülzow; Ulrich Arndt, Lauenburg; Hans Wolf, Schwarzenbek, all of (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 0 days.

(21) Appl. No.: 09/551,710

(22) Filed: Apr. 18, 2000

(30) Foreign Application Priority Data

May 4, 1999 (DE) ..... 199 20 379

(51) Int. Cl.[7] ..... B30B 11/08

(52) U.S. Cl. ..... 425/182; 425/193; 425/345; 425/353; 425/454

(58) Field of Search ..... 425/182, 193, 425/345, 353, 454

(56) References Cited

U.S. PATENT DOCUMENTS 4,191,523 A * 3/1980 Niederst et al. ..... 425/454
4,362,491 A * 12/1982 Livingstone ..... 425/193
4,988,275 A * 1/1991 Hinzpeter et al. ..... 425/345
5,004,413 A * 4/1991 Stopforth ..... 425/182

FOREIGN PATENT DOCUMENTS

EP 0 288 798 A2 4/1988
EP 0 460 295 A1 12/1990

* cited by examiner

*Primary Examiner*—Nam Nguyen
*Assistant Examiner*—Thu Khanh T. Nguyen
(74) *Attorney, Agent, or Firm*—Faegre & Benson LLP

(57) ABSTRACT

A rotary tabletting machine with a housing, with a matrix disk in the housing, which in an upper and a lower receiving section guides the upper and lower punch, with an upper and lower cam carrier ring rotationally rigid relative to the housing, for control of the upper and lower punch and with an upright drive shaft, below the matrix disk, driven by a rotational drive and releasably connectable to the matrix disk, wherein the matrix disk and the cam carrier rings with the upper and lower punch after release from the connections as an assembly may be commonly removed from the drive shaft, whereby the cam carrier rings laterally in each case are connected to at least one arm and the arms via an upright connection section are rigidly connected to one another and the connection section is releasably couplable to the housing such that it is secured against rotation.

9 Claims, 2 Drawing Sheets

ROTARY TABLETTING MACHINE

The invention relates to a rotary tabletting machine with a housing, with a matrix disk in the housing, which in an upper and a lower receiving section guides an upper and a lower punch, with an upper and a lower cam carrier rotationally rigid relative to the housing, for control of the upper and lower punches and with an upright drive shaft, below the matrix disk, driven by a rotational drive and releasably connectable to the matrix disk, wherein the matrix disk and the cam carrier rings with the upper and lower punches may be commonly removed from the drive shaft as an assembly.

From EP 0 288 798 there is known a tabletting machine with which the matrix disk which comprises receiving sections for the upper and lower punch and associated cam carrier rings form an assembly which may be lifted by a drive shaft when a suitable screw connection between the drive shaft and the matrix disk is released. In this manner a shortening of the standstill times of the machine given an exchange of a matrix disk for another may be achieved. Also the cleaning time may be significantly reduced in this manner. With the known tabletting machine the cam carrier rings are supported on corresponding holding rings of the housing, wherein these holding rings with the assembly are lifted from the drive shaft when the rotor of the machine as a whole is removed. For this purpose between the cam carrier rings and the holding rings there are provided catches which provide for the described entraining.

A similar tabletting machine is known from EP 0 460 295 A1.

With the known tabletting machine according to EP 0 288 798 the upper and lower cam carrier ring in each case per se is prevented from following the rotational movement of the matrix disk. Normally with conventional tabletting machines the upper cam carrier ring is secured on the machine upper part against rotation, and the lower cam carrier ring is fastened on the hub of the machine middle part. Further components which are required for the operation of the tabletting machine such as for example a tablet discharge, an upper scraper, a sorting-out device etc. are fastened on the machine housing and must likewise be removed before the matrix disk assembly may be removed for product change or cleaning purposes. The supply and control conduits which are connected to these components are led freely to these.

It is the object of the present invention to provide a rotary tabletting machine with which the change of a matrix disk assembly may be effected even more quickly.

This object is achieved by the features of the present invention.

With the rotary tabletting machine according to the invention to each cam carrier ring laterally there is connected at least one arm, wherein the lateral arms preferably are arranged in a vertical plane to one another when the matrix disk assembly is installed. The lateral arms are connected rigidly to a stiff or rigid essentially vertical connection section which for its part via the housing or the frame of the press is secured against rotation. The preferably U-shaped component formed by the connection section and the arms serves first and foremost as a torque support, i.e. secures the cam carrier rings against a rotation relative to the housing. Furthermore such a component is reached such that the cam carrier rings are automatically entrained when the matrix disk assembly is lifted or removed from the drive shaft. An axial and/or radial mounting of the cam carrier rings may take place opposite the receiving sections of the matrix disk, wherein the lower cam carrier ring may axially also be supported on the drive shaft. This is however not necessary but rather the lower cam carrier ring may axially also be supported on the upper cam carrier ring over the associated arm and the connection section.

The connection section of the tabletting machine according to the invention is releasably couplable to the housing. Preferably a type of plug coupling is provided with a plug coupling section on the connection section and a complementary coupling section on the housing so that on placing on the matrix disk assembly automatically there takes place a connection of the coupling parts and thus a rotational securement of the cam carrier rings.

In the described way and manner the matrix disk assembly becomes a compact unit which may be installed and removed even more simply that with the conventional tabletting machine.

The embodiment, according to the invention, of the tabletting machine has the further advantage that additional, peripherally arranged components or units which are required for operation such as tablet scraper, tablet discharge, sorting-out device, etc. may now be attached on the connection section. The connection of these components to the connection section may be constantly maintained when the matrix disk assembly is released and removed. Automatically the above parts are co-removed via the connection section. A time-consuming complicated release of these components or units from the machine housing before the removal of the matrix disk assembly may therefore be done away with.

Particularly advantageous is the design of the connection section as a holder or guide of supply and control conduits for the peripheral components, for example the supply with air, electricity and lubrication oil. For this purpose the coupling via which the connection section is connected to the machine housing may comprise a multitude of coupling parts, preferably plug coupling parts which cooperate with complementary coupling parts on the connection section when the connection section is coupled to the machine housing. To the plug coupling parts in the connection section there are then connected the conduits leading to the components.

The invention is hereinafter described in more detail by way of an embodiment example shown in the drawings.

A matrix disk 10 is designed in a conventional manner and comprises suitable die bores 12. To the matrix disk 10 there are connected receiving sections 14, 16 preferably formed as one piece with these as is roughly known from EP 0 460 295. The receiving sections 14, 16 in the known manner accommodate the upper and lower punch, wherein in FIG. 1 only the upper punch is indicated at 18. The punches cooperate in the known manner with the die bores 12. The upper and lower punch are controlled via cam carrier rings 20 and 22 respectively. They lie above and below the matrix disk and have suitable cam surfaces not to be seen, as this is known per se from tabletting machines and rotary presses. Pressing stations as they are likewise known for carrying out the pressing procedure, are not shown in FIG. 1.

Figure 1:
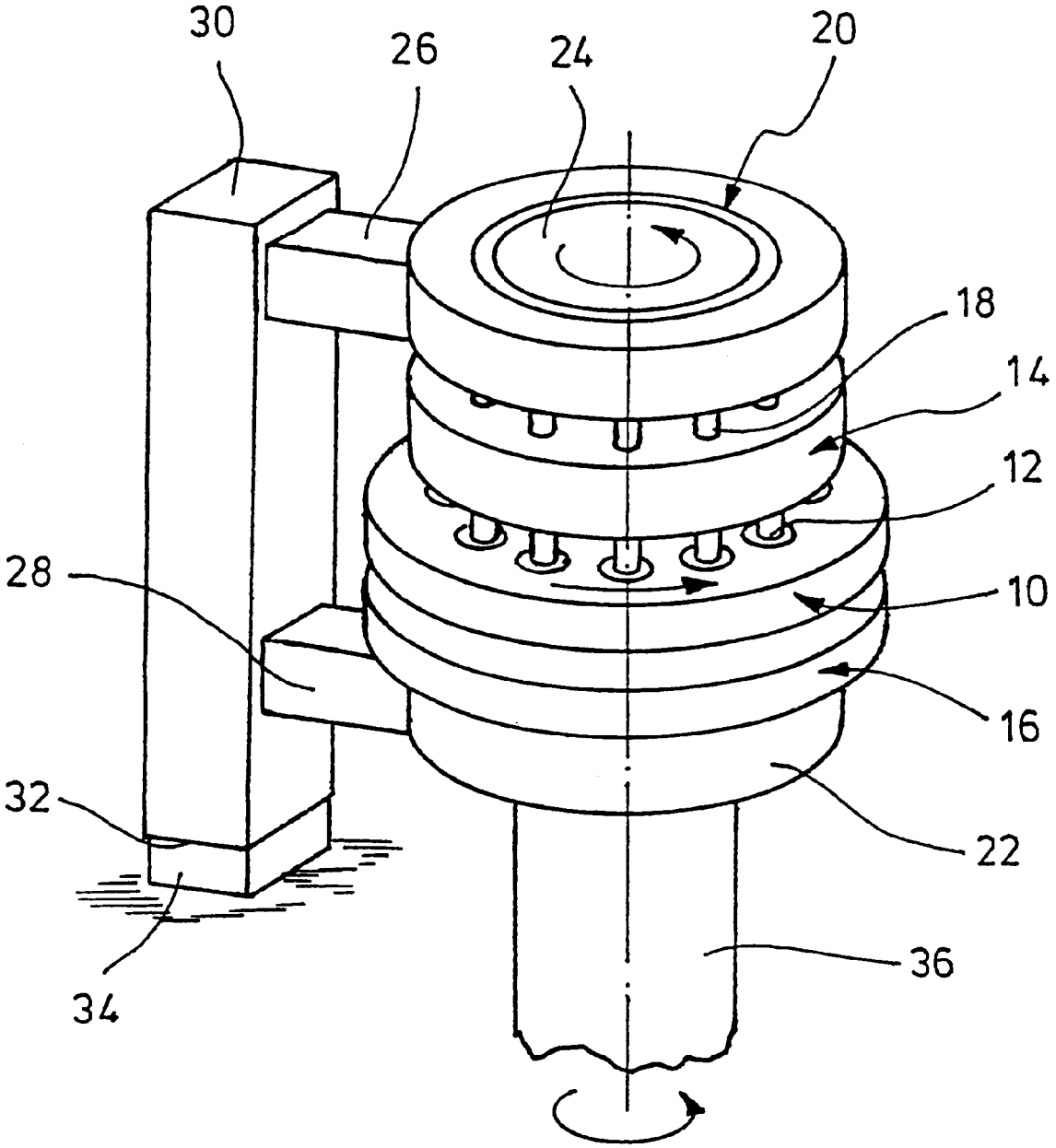
FIG. 1 shows perspectively and extremely schematically a matrix disk with cam carrier rings according to the invention.

One recognizes in FIG. 1 further that the receiving section 14 comprises an upper bearing collar 24 which is rotatably mounted in the cam carrier ring 20. The cam carrier ring 20 may also be rotatably supported axially on the receiving section 14, which however is not to be recognized.

To the upper cam carrier ring 20 there is rigidly connected an arm 26 which projects radially. To the lower cam carrier ring 22 there is rigidly connected a radially outwardly projecting arm 28. In the installation position shown in FIG. 1 the arms 26, 28 are aligned vertically to one another. The arms 26, 28 are rigidly connected to a connection web 30. The connection web 30 is formed in the lower part 32 as a plug coupling section which cooperates with a complementary plug coupling section 34 of the otherwise non-shown machine housing for the tabletting press.

The matrix disk 10 is driven via a vertical dive shaft 36 which can be driven by a rotational drive not shown and which is releasably couplable to the matrix disk 10. The releasable connection between the matrix disk 10 and the shaft 36 is not shown. It may be designed in the way and manner shown in EP 0 460 295. The drive shaft 36 may also via a radially extended section form an axial rotational mounting for the lower cam carrier ring 22. The cam carrier ring 22 may however below also be supported on the upper cam carrier ring 20 via the arm 28 and the connection web 30 and the arm 26.

In the simplest case the U-shaped component which is formed from the arms 26, 28 and the connection web 30 serves exclusively as a torque support which prevents a relative rotation of the cam carrier rings 20, 22 to one another as well as a relative movement to the non-shown machine housing, whilst the axial load is accommodated by the shaft 36. With the disassembly of the matrix disk 10 therefore the cam carrier rings 20, 22 are automatically removed with the U-shaped component when this is removed. A releasing of these parts from the housing is not required when, as explained, between the connection web 30 and the housing there is realized a simple plug connection.

Within the plug coupling formed from the connection or coupling sections 32, 34 coupling parts for connection or supply or control conduits for peripheral devices may be provided. From the machine housing the corresponding conduits are led to the coupling section 34 rigid with the housing, and conduits within the connection web 30 are connected to coupling parts in the coupling section 32 so that on putting together the coupling sections 32, 34 also the conduits are automatically connected to one another (multi-coupling).

The connection web 30 may serve the retention of individual components of the rotary press, such as for example tablet scraper, sorting-out device, tablet discharge or likewise. Furthermore in the connection web also there may be arranged a device for the tightness measurement of the punches. By way of this a measuring possibility for the upper as well as the lower cam carrier ring 20 and 22 is given.

Figure 2:
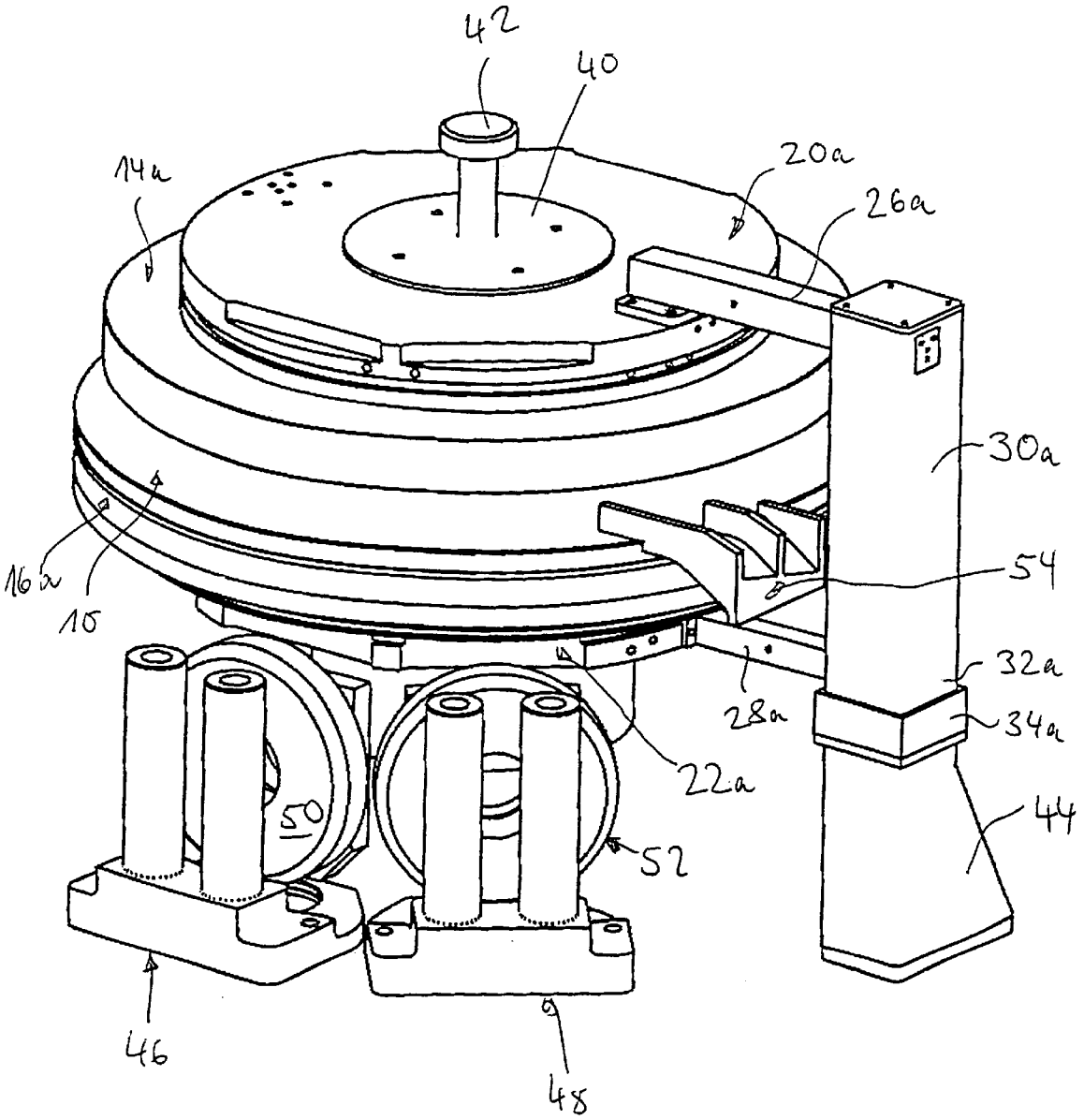
FIG. 2 shows a similar embodiment form as FIG. 1.

With the embodiment form according to FIG. 2 those parts which are equal to that according to FIG. 1 are provided with the same reference numerals, but however the index a is added.

The construction of the schematically shown rotary tablet press corresponds largely to the construction of the embodiment form according to FIG. 1. One recognizes that to the upper cam carrier ring 20 there is screwed a plate 40 with a peg 42. With the help of a hoist the unit shown completely in FIG. 2 is lifted when the hoist engages on the peg 42.

In FIG. 2 it is further to be recognized that the lower plug coupling section 34 is connected to a support 44 which is rigid with the machine, i.e. part of the housing or of the machine frame. As can be further recognized the upper arm 26*a* is screwed to the upper side of the cam carrier ring 20*a*. The lower arm 28*a* is in contrast laterally attached on the lower cam carrier ring 22*a,* for example likewise by way of screwing.

With the embodiment form according to FIG. 2 further two pressing stations 46, 48 are shown, with a pressing roller 50 and 52 respectively. With the help of the pressing rollers 50, 52 the lower punches are lifted. The punches are not indicated in FIG. 2. The upper pressing rollers are also not shown. This however corresponds to conventional tablet presses. In FIG. 2 finally also a tablet discharge is shown which is allocated to the upper side of the actual matrix disk and which is connected to the web 30*a*. This connection is however not shown.

What is claimed is:

1. A rotary tabletting machine with a housing, with a matrix disk in the housing, which in an upper and a lower receiving section guides an upper and a lower punch, with an upper and a lower cam carrier ring rotationally rigid relative to the housing, for control of the upper and lower punches and with an upright drive shaft, below the matrix disk, driven by a rotational drive and releasably connectable to the matrix disk, wherein the matrix disk and the cam carrier rings with the upper and lower punches may be commonly removed from the drive shaft as an assembly, characterised in that the cam carrier rings (20, 22) are each laterally connected to at least one of two arms (26, 28) and the arms (26, 28) are rigidly connected to one another via an upright connection section (30) and the connection section (30) is releasably couplable to the housing such that it is secured against rotation.

2. A rotary tabletting machine according to claim 1, characterised in that the connection section (30) comprises a plug coupling section (32) which with a complementary plug coupling section (34) of the housing forms a plug coupling and which automatically cooperates with this complementary plug coupling section when the matrix disk (10) and the cam carrier rings (20, 22) are placed as an assembly on the drive shaft (36).

3. A rotary tabletting machine according to claim 2 characterised in that the plug coupling sections (32, 34) of the plug coupling comprises a plurality of complementary cooperating coupling parts for supply or control conduits for the assembly and peripheral devices on the assembly.

4. A rotary tabletting machine according to claim 3, characterised in that the coupling parts are formed as plug coupling parts.

5. A rotary tabletting machine according to claim 1 characterised in that the arms (26, 28) and the connection section (30) form a U-shaped rigid component.

6. A rotary tabletting machine according to claim 1 characterised in that the cam carrier rings (20, 22) are mounted on a pair of receiving sections (14, 16).

7. A rotary tabletting press according to claim 1 characterised in that one cam carrier ring (22) is supported on the drive shaft (36).

8. A rotary tabletting press according to claim 1 characterised in that one cam carrier ring (22), is supported by an associated arm (28).

9. A rotary tabletting machine according to claim 1 characterised in that a tablet discharge and a scraper and a sorting-out device are attached on the connection section (30).

* * * * *